US005295868A

United States Patent [19]

Viaud et al.

[11] Patent Number: 5,295,868

[45] Date of Patent: Mar. 22, 1994

[54] SHIELDED HARNESS PRE-EQUIPPED SO THAT A CONNECTOR CAN BE MOUNTED THEREON

[75] Inventors: André Viaud, Crosne; Pascal Clouet, Gregy sur Yerres, both of France

[73] Assignee: Filotex, Draveil, France

[21] Appl. No.: 9,985

[22] Filed: Jan. 27, 1993

[30] Foreign Application Priority Data

Jan. 29, 1992 [FR] France ..... 92 00949

[51] Int. Cl.[5] ..... H01R 13/658

[52] U.S. Cl. ..... 439/610; 174/84 C; 174/74 R

[58] Field of Search ..... 174/74 R, 84 C, 88 C; 439/610, 98, 99

[56] References Cited

U.S. PATENT DOCUMENTS 3,753,215 8/1973 Moore .
4,025,145 5/1977 Shaffer et al. ..... 439/610
4,026,628 5/1977 Duffner et al. .
5,183,417 2/1993 Bools ..... 439/610

FOREIGN PATENT DOCUMENTS 1079148 4/1960 Fed. Rep. of Germany .
3615356 11/1987 Fed. Rep. of Germany .

*Primary Examiner*—Gary F. Paumen
*Attorney, Agent, or Firm*—Sughrue, Mion, Zinn, Macpeak & Seas

[57] ABSTRACT

A pre-equipped shielded harness has at least one end portion formed of a bundle of twisted-together conductors covered by a shielding braid. The harness includes an expander having cross-sectional dimensions substantially identical to those of a rear of a connector to be connected to the end portion. The expander is positioned at the location at which the connector is to be connected, and is covered by the shielding braid by preforming the shielding braid over the expander. The shielded harness has high magnetic protection.

9 Claims, 1 Drawing Sheet

SHIELDED HARNESS PRE-EQUIPPED SO THAT A CONNECTOR CAN BE MOUNTED THEREON

The present invention relates to shielded harnesses serving different connection points. More particularly the invention relates to mounting a connector on an end portion of a shielded harness used under conditions of high electromagnetic irradiation.

BACKGROUND OF THE INVENTION

Such a shielded harness has a defined layout, in which it comprises a linear cord of conductors, or a network made up of conductors and having multiple branches, and end connectors for connecting the harness to the various connection points.

For certain applications, it is impossible or not desirable to equip the shielded harnesses with all or some of their connectors before the harnesses are laid. This is particularly true when the harness passes through a wall, through which a passage cannot be provided that is large enough for the connector, since the diameter of the connector is generally larger than the diameter of the cord or of the branch of the network to which it is normally connected. This may also be true when the connectors are relatively fragile and may be damaged by handling while the harness is being transported or laid.

In known manner, a linear cord, and in particular the linear portions of a network may be shielded against electromagnetic interference by means of metal shielding braids. The rear connection portions of the connectors via which the connectors are connected to the cord or to the network must in turn be protected by shielding. Such protection may be obtained by handling the end of the shielding braid of the cord or of the branch of the network roughly so that the shielding braid can be threaded onto the rear portion of the connector.

Such rough handling degrades the shape of the braid. Although such rough handling is acceptable for harnesses subject to low electromagnetic stresses, it is not acceptable for harnesses subject to high electromagnetic stresses.

Also in known manner, the low performance levels obtained by braiding the shielding braid onto the rear portion of the connector can be improved by mounting a heat-shrinkable sheath over the rear portion of the connector and over the end of the braid. The heat-shrinkable sheath is there to provide sealing on top of the shielding braid, but in practice, it is uncommon to obtain a sheath that shrinks enough and that offers almost perfect sealing when there is a large difference between the diameter of the connector and the diameter of the cord or of the branch to which the connector is connected. Furthermore, installing the sheath is not always easy, in particular when the connector is already connected, given that the sheath is installed after the harness has been laid.

An object of the present invention is to connect a connector to one end of a harness that is already shielded, while avoiding the above-mentioned drawbacks, and enabling in particular the connector to be mounted easily and quickly, with high electromagnetic protection at the connector, and without the shielding of the end portion of the harness that is connected to the connector being degraded.

The invention further advantageously enables a faulty connector in place to be replaced by a new connector, under the above-mentioned conditions of mounting and of protection.

SUMMARY OF THE INVENTION

The invention provides a shielded harness pre-equipped so that a connector can be mounted on an end portion of the harness, the harness having a bundle of twisted-together conductors and a shielding braid covering the bundle, the harness including an expander having cross-sectional dimensions substantially identical to those of a "rear" connection end of the connector, the expander being positioned on the end portion substantially at the location at which the connector is to be connected, and being at least partially covered by the shielding braid which is preformed over the expander and to the cross-sectional dimensions thereof.

The harness further has, inter alia, at least one of the following additional features:

a "rear" end of the expander on the end portion has a curved profile;

a positioner mounted on the bundle of conductors forms an abutment for the "front" end of the expander on the end portion; and the shielding braid has a self-locking loop made on the conductor bundle and almost adjoining the expander.

BRIEF DESCRIPTION OF THE DRAWING

The characteristics of the present invention will appear on reading the following description of embodiments given with reference to the accompanying drawing, in which.

MORE DETAILED DESCRIPTION

Figure 1:
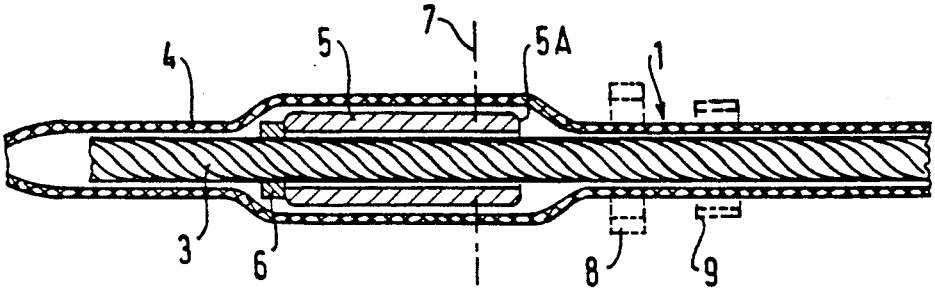
FIG. 1 is a fragmentary diagrammatic view in section of a pre-equipped shielded harness of the invention, with only one pre-equipped shielded end portion of the harness being shown.

FIG. 1 shows only one of the end portions of a shielded harness 1, which end portion is pre-equipped so that a connector 2 (FIG. 2) can be mounted on the end portion. The end portion is designated below by the reference 1 which is the reference of the harness of which it is part.

Such a shielded harness has a pre-established layout. For example, it is constituted by a linear cord or by a network of conductors, the network having multiple branches and one or more forks. The harness is connected to two end connectors on the cord, or to as many connectors as there are multiple end branches from the network, for the purposes of serving corresponding connection points.

The shielded harness has twisted-together conductors, all or some of which are part of the end portion 1. The conductors in the end portion are referenced 3.

The harness is shielded over its entire length. The shielding is provided by a single-layer or a multi-layer shielding braid 4, at least over the linear portions of the harness, and therefore over the end portion 1 in question.

In accordance with the invention, the end portion 1 is equipped with an expander 5 mounted directly on the bundle of twisted-together conductors making up the end portion, and before the end portion is shielded. The expander is positioned at the location at which the above-mentioned connector is to be connected. The shielding braid 4 is then made during the same braiding operations, with the expander being in place on the bundle of conductors.

Advantageously, a positioner 6 is retained substantially at the end of the bundle of conductors 3. The positioner serves as a front abutment for the expander, which is then properly positioned, and prevents the expander from moving forwards or coming out from underneath the shielding braid both during the braiding operations and subsequently.

The cross-sectional dimensions of the expander are as close as possible to being the same as those of the rear end of the connector. The "rear" end 5A of the expander, which end is the innermost one along the end portion 1, is shaped into a rounded or conical shape. This shape ensures a smooth and gradual transition for the shielding braid between the expander and the bundle of conductors, the expander and the bundle being of different cross-sectional dimensions.

The expander is made of a hard material, which may be metal or plastic.

The expander may be re-used many times, in particular when it has a complex shape, and is then relatively expensive.

The shielding braid 4 is made in one or more layers one on top of another and is made continuously over the length of the end portion, which is already carrying the expander. The braid is thus preformed over the expander to the cross-sectional dimensions thereof, and therefore to the cross-sectional dimensions of the rear end of the connector. Braiding may be performed with braiding pitches on the expander and on the bundle of conductors that are different, with a continuously varying pitch at the transition, so that where applicable, and in particular when there is a large difference between the cross-sectional dimensions of the expander and those of the bundle, high-performance protection is obtained over the entire length of the end portion 1, including the length over the expander.

The shielding braid 4 may either cover the entire expander, or only cover part of it. Since the braid is preformed to the cross-sectional dimensions of the rear end of the connector, it avoids any rough handling that may degrade the characteristics of the braid when the connector is being installed.

The expander 5 further serves as an abutment surface for cutting the shielding braid 4 to the right length. The expander also protects the conductors it covers from being damaged when the braid is being cut. The plane on which the shielding braid is cut is referenced 7, and is situated at a distance from the rear end of the expander that is substantially equal to the length of the rear connection end of the connector. The braid is cut to enable the surplus length of braid to be removed, and the expander to be withdrawn, so that the rear end of the connector can be slid into place under the shielding braid without deforming it.

Advantageously, fixing and protection accessories, such as a fixing ring 8 represented by dashed lines, are initially provided on the end portion pre-equipped ready for the connector to be installed, or, when they are of closed structure, they are mounted after the surplus length of shielding braid has been cut off and the expander has been removed. The accessories are deformable or shrinkable, so that the shielding braid can be subsequently clamped onto the rear end of the connector, in particular either by crimping, cryogenics, or magnetostriction, depending on the nature of the materials of which the accessories are made. Naturally, different means may be used to fix the shielding braid to the rear end of the connector.

A protective flexible metal strip 9, looped back on itself, may also be associated with the fixing accessories, as shown by dashed lines.

The metal strip is slid over the cut end of the braid, after the expander has been removed. It serves to protect the operator while the operator is locking the shielding braid on the connector, by avoiding any injuries that might be caused by the ends of the cut shielding braid which the metal strip covers.

Figure 2:
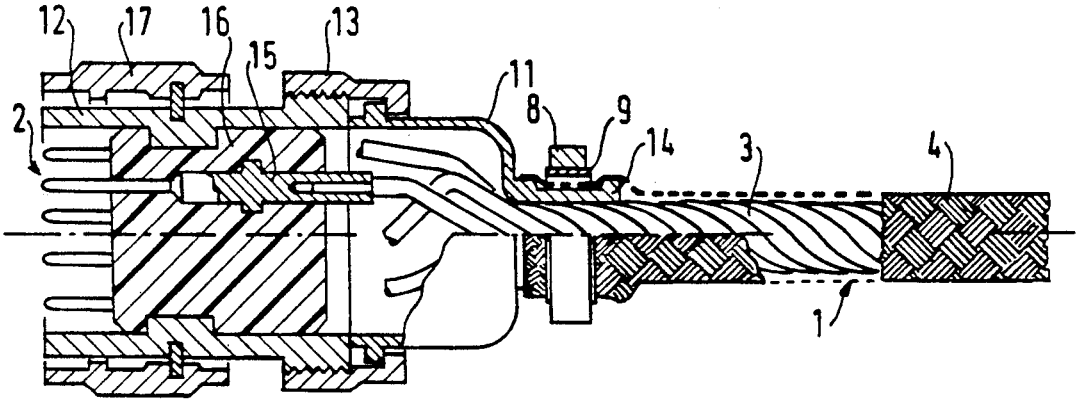
FIG. 2 is a view in partial section of the end portion to which a connector has been connected.

FIG. 2 shows the end portion 1 connected to its connector 2. The connector has a body made in two portions, namely a rear portion 11 and a front portion 12, which are assembled together by means of a link nut 13.

The rear portion delimits a chamber in which the twisted-together conductors making up the bundle 3 are splayed out and distributed, the surplus length of the conductors optionally being cut off. The rear portion has a rear end which forms a rear collar 14 via which the conductors are inserted into the chamber. The rear collar is inserted under the shielding braid which is then fixed by means such as fixing ring 8, optionally with the interposed protection 9.

The front portion 12 includes a plurality of contacts 15 mounted and retained in an insulating block 16, the conductors of the bundle being connected to the contacts. The contacts also project from the insulating block at the front face of the connector. A front peripheral nut 17 on the connector locks it to a complementary connector at the point at which the end portion is connected.

Figure 3:
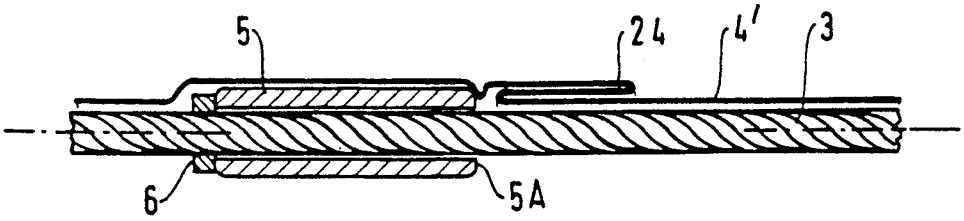
FIG. 3 is a variant on FIG. 1.

In the variant shown in FIG. 3, elements that are identical to those in FIG. 1 are designated by the same references. The shielding braid is designated by the reference 4' so as to express its differences with respect to the FIG. 1 shielding braid, which differences are specified below.

The shielding braid 4' further includes a self-locking loop 24 made with the braid. The loop almost adjoins the rear end 5A of the expander, and extends, in the range for 1 centimeter to a few centimeters, over the bundle of conductors 3. The loop is obtained by means of go-and-return braiding motion, while the various layers or at least the final layer is/are being made (when the shielding braid is multi-layer), so as to form a double hem.

The loop prevents the multiple layers in the shielding braid from slipping on one another, in particular when the surplus length of the braid is being cut off, and the connector is being installed and connected. The loop acts directly as a fixing ring for fixing the shielding braid on the bundle of conductors.

The loop also enables the connected connector to be dismounted for the purposes of maintenance, repair, or replacement, without forcing and displacing the shielding braid along the bundle of conductors. This is necessary in particular when the harness is used under high-temperature conditions for which its connectors include parts which are made of ceramic and which are therefore fragile, and the loop makes the operation feasible and easy to perform. The self-locking loop also opposes any relative displacement of the shielding braid and of the bundle that may occur when they are mechanically urged by vibration under certain conditions of use, thereby avoiding any rubbing and resulting degradation of the conductor insulators.

We claim:

1. A shielded harness for coupling to a connector and having a bundle of twisted-together conductors and a tubular shielding braid covering said bundle of conductors, said harness including a tubular expander having cross-sectional dimensions substantially identical to those of a rear connection end of said connector, the expander being positioned on an end portion of said harness at a location at which said connector is to be connected, and being partially covered by said shielding braid, said shielding braid being preformed over the expander and corresponding to the cross-sectional dimensions thereof, wherein the expander may be removed axially from the end of said harness and the rear connection end of said connector connected thereto, and wherein said shielding braid has a braiding pitch over said expander that is different from its braiding pitch over said bundle of conductors.

2. A harness according to claim 1, wherein a rear end of said expander has a curved profile and constitutes a transition for said shielding braid, between said expander and said bundle of conductors, the rear end being that one of the ends of said expander which is innermost along said end portion.

3. A harness according to claim 1, wherein said shielding braid has almost continuously varying pitch along a transition region between the expander and the bundle of conductors.

4. A harness according to claim 1, including a positioner disposed almost at the end of the bundle of conductors and abutting against the front end of the expander, the front end being the outermost one along said end portion.

5. A shielded harness for coupling to a connector and having a bundle of twisted-together conductors and a tubular shielding braid covering said bundle of conductors, said harness including a tubular expander having cross-sectional dimensions substantially identical to those of a rear connection end of said connector, the expander being positioned on an end portion of said harness at a location at which said connector is to be connected, and being partially covered by said shielding braid, said shielding braid being preformed over the expander and corresponding to the cross-sectional dimensions thereof, wherein the expander may be removed axially from the end of said harness and the rear connection end of said connector connected thereto, further comprising a first fixing accessory means slid over the shielding braid for retaining the end of the shielding braid on said connector once the connector is mounted in place of said expander and is connected to said end portion.

6. A harness according to claim 5, further comprising a protective second accessory means slid over the shielding braid for covering the end of said shielding braid once said connector has been mounted in place of said expander on said harness.

7. A shielded harness for coupling to a connector and having a bundle of twisted-together conductors and a tubular shielding braid covering said bundle of conductors, said harness including a tubular expander having cross-sectional dimensions substantially identical to those of a rear connection end of said connector, the expander being positioned on an end portion of said harness at a location at which said connector is to be connected, and being partially covered by said shielding braid, said shielding braid being preformed over the expander and corresponding to the cross-sectional dimensions thereof, wherein the expander may be removed axially from the end of said harness and the rear connection end of said connector connected thereto, wherein said shielding braid includes a self-locking loop made in the form of a double hem on said bundle of conductors and almost adjoining said expander.

8. A harness according to claim 7, wherein the length of said self-locking loop lies in the range one centimeter to a few centimeters.

9. A harness according to claim 8, wherein the connector has a rear end at the location of said expander, and being connected to said bundle of conductors, and being partially covered by the shielding braid, whereby said connector is dismountable by the presence of said self-locking loop.

* * * * *